United States Patent [19]

Landkammer

[11] 4,233,595

[45] Nov. 11, 1980

[54] CHAIN-TYPE DOOR LATCH AND ALARM

[75] Inventor: Franz J. Landkammer, Neu-Anspach, Fed. Rep. of Germany

[73] Assignee: Christoph Emmerich KG, Frankfurt am Main, Fed. Rep. of Germany

[21] Appl. No.: 964,923

[22] Filed: Nov. 30, 1978

[51] Int. Cl.[3] ..... G08B 13/06

[52] U.S. Cl. ..... 340/542; 200/61.93; 340/545; 340/548

[58] Field of Search ..... 340/545, 548, 542; 200/61.93

[56] References Cited

U.S. PATENT DOCUMENTS

| | | | |
|---|---|---|---|
| 2,747,177 | 5/1956 | Keller | 340/548 |
| 3,714,644 | 1/1973 | Hellstrom | 340/542 X |
| 3,754,224 | 8/1973 | Roy et al. | 340/545 |

*Primary Examiner*—David L. Trafton
*Attorney, Agent, or Firm*—Karl F. Ross

[57] ABSTRACT

A door latch and alarm apparatus has a support mounted on the door and a support mounted on the doorjamb. A relatively inextensible and flexible element is anchored to the door support and has a free end provided with an end piece fittable in a latch on the doorjamb support. A pair of conductors, one of which may be the inextensible and flexible element, extend from the door support to the end piece where they are connected together via a resistor. At their other ends these conductors are connected to a resistance detector which operates an alarm whenever the resistance between the two conductors increases, as when the conductors are broken, and whenever it decreases, as when they are short-circuited.

13 Claims, 8 Drawing Figures

CHAIN-TYPE DOOR LATCH AND ALARM

FIELD OF THE INVENTION

The present invention relates to a door latch and alarm apparatus. More particularly this invention concerns such an apparatus of the chain-type which allows the protected door to be opened only a limited distance from the doorjamb before preventing further opening.

BACKGROUND OF THE INVENTION

A chain-type door latch is known which has a support mounted on the door, another support secured to the doorjamb, and a flexible and inextensible element—normally a chain—anchored to the door support and releaseably engageable with the support on the doorjamb. Such an arrangement allows the door to be opened a limited distance so that a person on the inside of the door can see, talk to, and even receive small items from a person outside the door without having to open the door completely and allow the outside person in.

In a common variant on this type of latch a key-operable mechanism is provided on the doorjamb support so that after opening the door by its main lock a person equipped with a key can reach in through the narrow gap that the chain allows the door to open to actuate the key mechanism on the doorjamb and thereby release the end piece of the chain. Such a latch is typically added to a door to increase the security thereof, in particular in an apartment where the tenant fears that a key to the main apartment-door lock might have fallen into the wrong hands.

Finally it is known to provide chain-type latches of the two above-described types with an alarm which sounds whenever an excessive strain is exerted on the chain or other element extending between the door-mounted support and the doorjamb-mounted support. This arrangement has the advantage that if the latch is forced the alarm will sound to alert persons in nearby areas and if possible to scare away the person making the forced entry.

This last type of described system has the disadvantage, however, that the latch can be overcome without sounding the alarm through the simple expedient of cutting the flexible element extending between the door and the doorjamb, so that no strain is exerted on the chain or other element that would cause the alarm to be emitted. Another disadvantage of these systems is that during normal use an excessive force is sometimes exerted against the door, so that the alarm is emitted accidentally when in fact no cause for alarm exists.

OBJECTS OF THE INVENTION

It is therefore an object of the instant invention to provide an improved door latch and alarm apparatus.

Another object is to provide such an apparatus which will emit an alarm whenever an attempt is made to force the door open, or whenever the structure preventing opening of the door is tampered with in an attempt to prevent the alarm from being emitted.

Yet another object is to provide such an apparatus which will emit an alarm whenever it is subject to an excess force of tampering, but which will never emit an alarm under normal use conditions.

SUMMARY OF THE INVENTION

These objects are attained according to the instant invention in an apparatus of the above-described general type which is provided with circuit means including at least one conductor extending between the door support and the end piece of the flexible and inextensible element anchored in the door support and having a free end provided with this end piece. This conductor forms a closed circuit path between the end piece and the door support and is connected to alarm means which emits an alarm whenever this path is interrupted. Thus with a system according to the instant invention if the conductors of the circuit means are cut or torn loose at either end, the alarm will be activated.

According to further features of this invention the circuit means has a pair of conductors which are connected together at the end piece by means of a resistor. The alarm means includes a sensor which activates the alarm whenever resistance between the two conductors drops below a predetermined limit or rises above another predetermined limit. Thus if the cable is cut, so as to open-circuit the conductors, the alarm will go off and similarly, if the conductors are exposed and shorted out before being cut by a more devious would-be entrant, the alarm will also go off. These conductors are relatively strong and durable between the end piece and the door support, but are made relatively frangible at the end piece, so that a strong pull exerted on the conductors will tear them loose at the end piece and open-circuit them.

In accordance with another feature of this invention the relatively frangible ends of the conductors are formed as thin metallic strips inside the end piece which are overlain with spacing by the conductive head of a screw which holds the doorjamb support to the doorjamb so that when a strong tug is exerted on these conductors it will pull up and short against the screw head. Thus if a continuously growing force is applied to the conductors they will first of all short out, thereby activating the alarm, and thereafter open-circuit, which will also activate the alarm in the event that they do not make good contact with the head of the screw that shorts them out. It is also possible to anchor the two conductors one one of the supports to a highly fragile anchor so that any strong pull on these conductors will break them free and open-circuit them so as to set off the alarm.

The conductors according to this invention may be provided in a relatively light cable extending parallel to the flexible and inextensible element between the door support and the doorjamb support. Such a cable would have a length slightly greater than that of the flexible and inextensible element, normally constituted as a chain, so that it would not be pulled taut unless the chain were broken. It is also possible to use the flexible and inextensible element itself as one of the conductors, or to constitute it as a heavy wire inside a multiwire cable that forms both the conductors and the flexible and inextensible element.

The latch according to this invention may be a key-operated mechanism which can be operated through the gap between the door and the doorjamb once the main door lock has been operated and the door opened to the extent allowed by the flexible and inextensible element. The latch is, therefore, operated by the key to release the end piece to which is attached the flexible element and the conductors.

SPECIFIC DESCRIPTION

Figure 1:
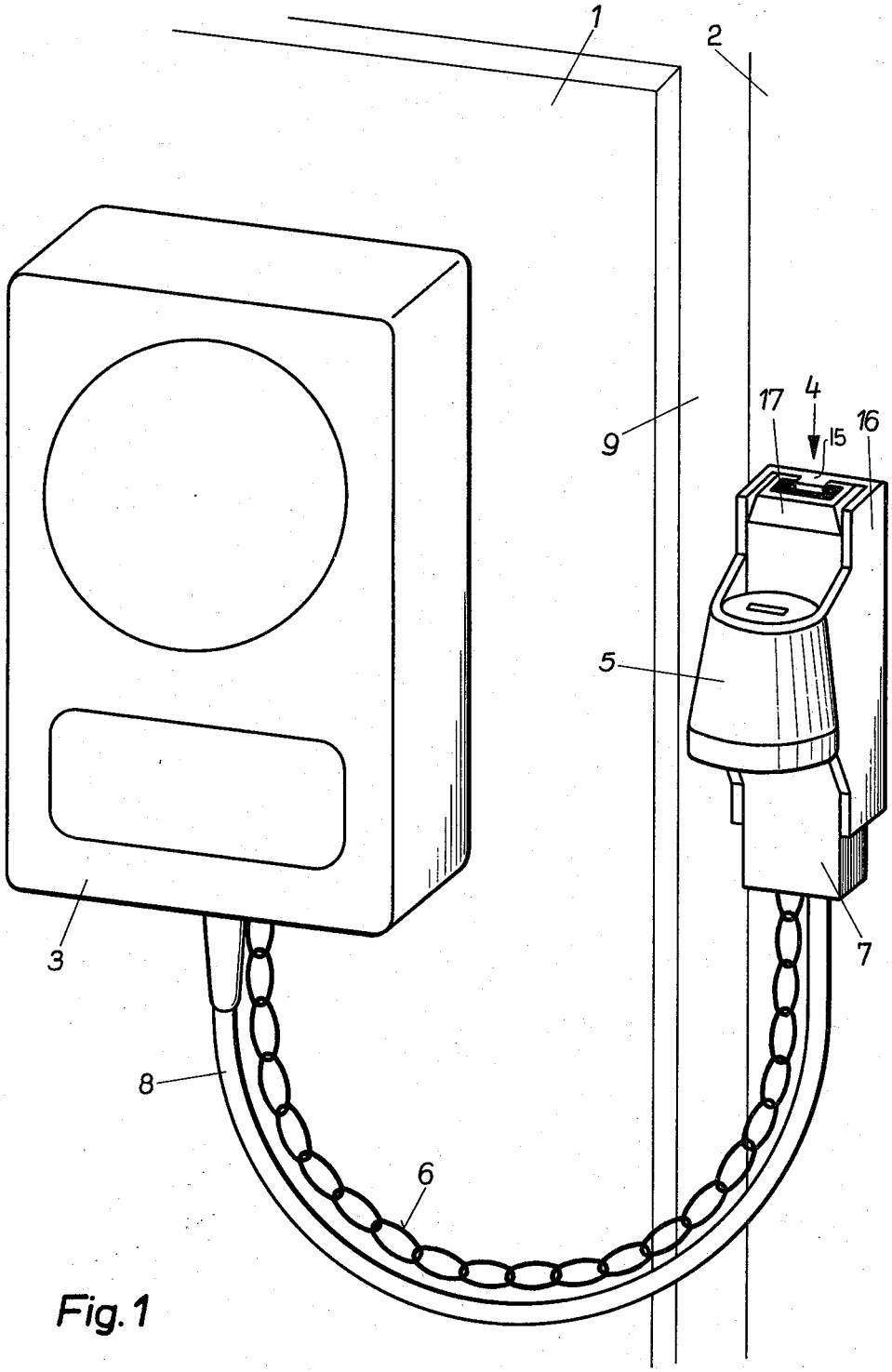
FIG. 1 is a perspective view of the apparatus according to this invention.

Shown in FIG. 1 a latch and alarm apparatus is adapted to be mounted on a door 1 normally received in a doorjamb 2. The apparatus comprises a door-mounted support or housing 3 and a doorjamb-mounted support 4. A key-operated latch 5 on the doorjamb support 4 is lockingly engageable with an end piece 7 carried at the free end of a chain 6 and of a two-conductor light cable 8. The chain 6 is somewhat shorter than the cable 8, to allow the door 1 to be opened to a limited extent so that it is spaced by gap 9 from the jamb 2.

Figure 2:
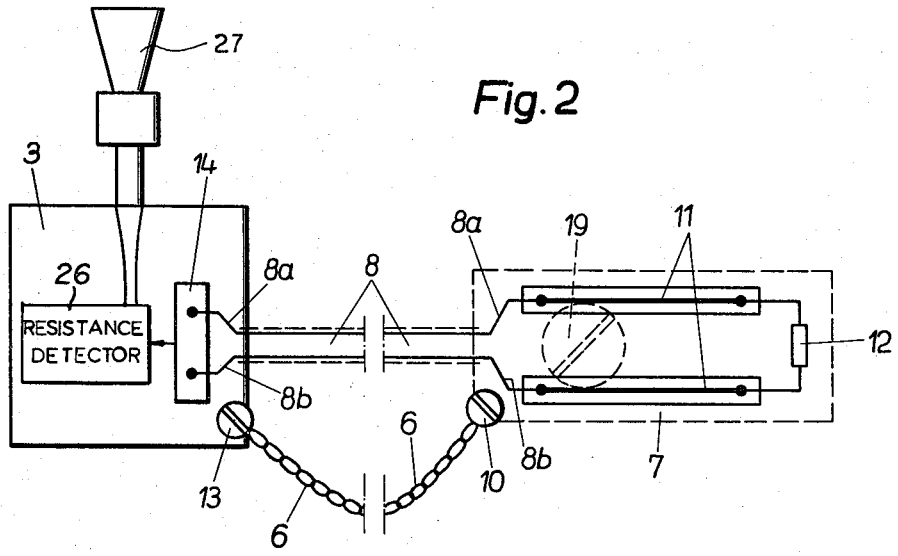
FIG. 2 is a schematic diagram of the apparatus of FIG. 1.

As shown in FIG. 2 the chain 6 is connected at one end to an anchor screw 10 on the end piece 7 and at its other end to an anchor screw 13 on the housing 3. The cable 8 has two conductors 8*a* and 8*b* which are each connected in the end piece 7 to one end of a respective conductors strip 11. The other ends of these strips 11 are interconnected by means of a resistor 12. The conductors 8*a* and 8*b* are connected at their other ends on the housing 3 to a terminal block 14 in turn connected to a resistance detector 26 itself connected to an acoustical alarm or horn 27.

Figure 3:
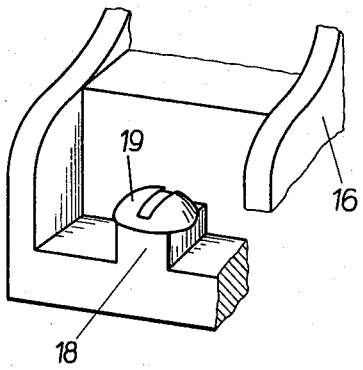
FIGS. 3 and 4 are large-scale perspective and end views of a detail of the apparatus of FIG. 1.
Figure 4:
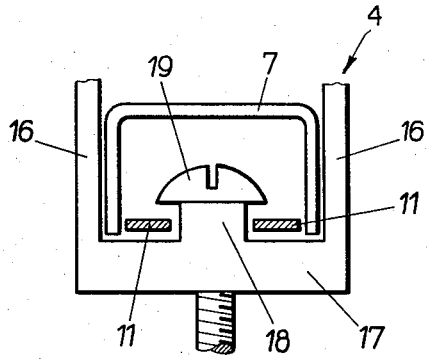

The doorjamb support 4 as shown in FIGS. 1, 3, and 4 is shaped as a channel having a pair of sides or cheeks 16 and a base plate 17. Upper projections 18 of the base plate 17 equispaced between the cheeks 16 are formed with throughgoing holes through which pass the shanks of screws 19 that secure the support 4 to the doorjamb 2. The screws 19 have large heads and the end piece 7, which fits plug-fashion into the bottom of the support 4, is of U-section with the two strips 11 positioned so that, when the end piece 7 is inserted fully upwardly into the support or socket 4, the strips 11 will underlie the heads of the screws 19. A stop 15 at the upper end of the channel forming the socket or guide 4 determines the end rest position for the endpiece 7. In this position a bolt operated by the key mechanism 5 fits into a recess on the upper wall of the U-section endpiece 7 to lock it tightly in place. Rotation of the key in the key mechanism 5 pulls the bolt out of the recess and allows the endpiece 7 to drop downwardly out of the support 4.

The user of such a lock need merely push the end piece 7 upwardly into the support 4 to set it, which action can be done easily from inside the door after closing it and just as easily from outside the door through the gap 9. To release the endpiece 7 from the support 4 the key is rotated in latch 5.

A person attempting to make a forced entrance through the door 1 from the outside will, after having overcome the main door lock, have to overcome the latch and alarm apparatus according to this invention. If such a would-be entrant simply exerts a sufficiently large force against the door to break the chain 6, the force will be invariably sufficient to exert considerable tension on the cable 8. Such tension will either pull the conductors 11 against the head of the screw 19 so as to short them out, whereupon the resistance detector 26 will set off the alarm 27, or will simply exert so much tension on these relatively fragile strips 11 that they will rupture, thereby open-circuiting the conductors 8*a* and 8*b*, so that once again the resistance detector 26 will set off the alarm 27. If in the alternative, the would-be entrant cuts the cable 8 the conductors 8*a* and 8*b* will again be open-circuited so that the alarm 27 will sound. A knowledgeable burglar might reach through the gap 9 and cut open the cable 8 so as to expose the conductors 8*a* and 8*b*. These conductors 8*a* and 8*b* could then be connected together in the manner that is standard to overcome many conventional burglar alarms, so that the cable 8 could be cut downstream of the location where the conductors 8*a* and 8*b* are shorted. Such a procedure will not, however, work with the system according to this invention since this will drop the resistance between the conductors 8*a* and 8*b* to below the threshold level for the resistance detector 26, which will once again set off the alarm 27.

Figure 5:
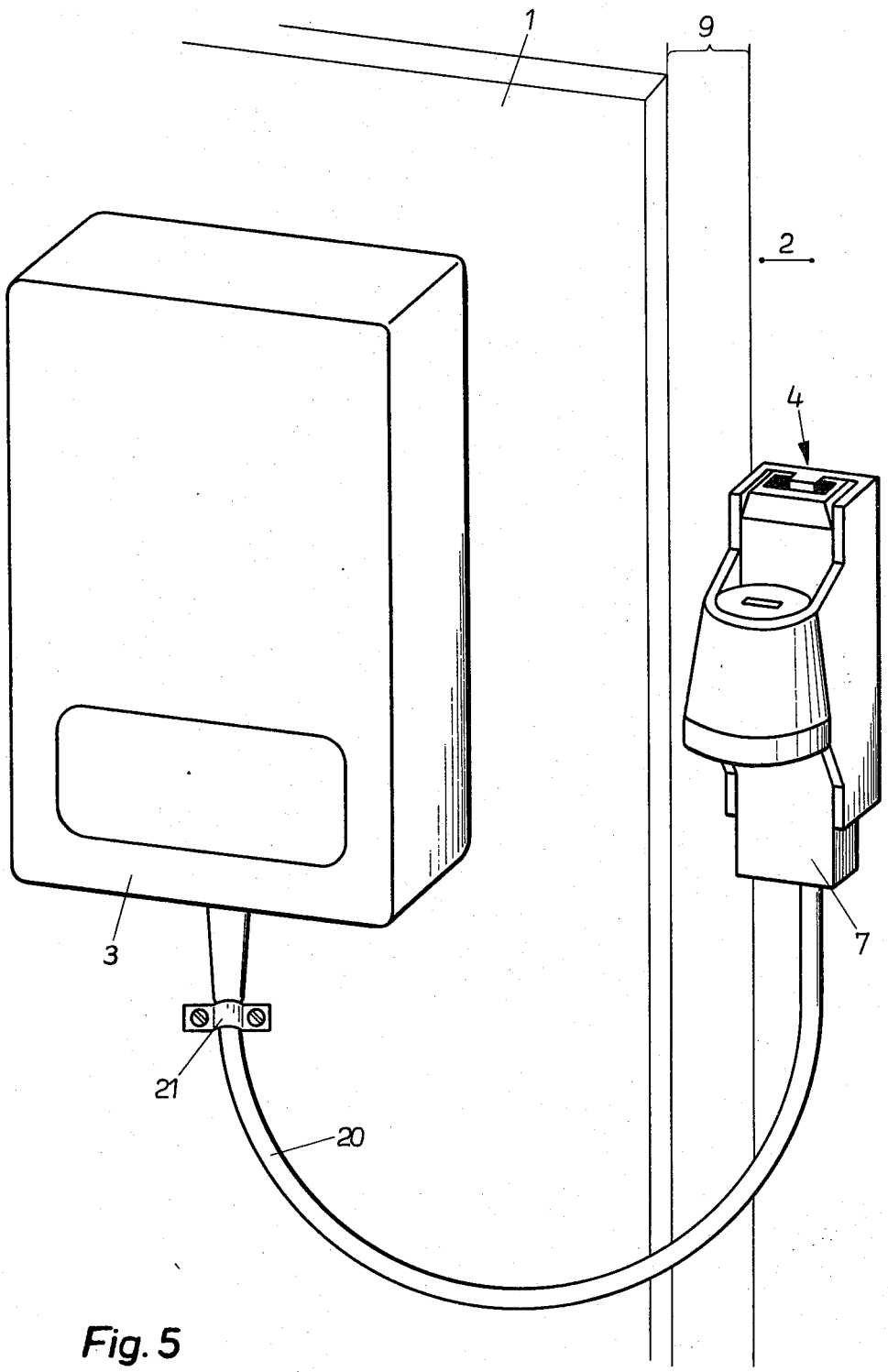
FIG. 5 is a view similar to FIG. 1 of another apparatus in accordance with this invention.
Figure 6:
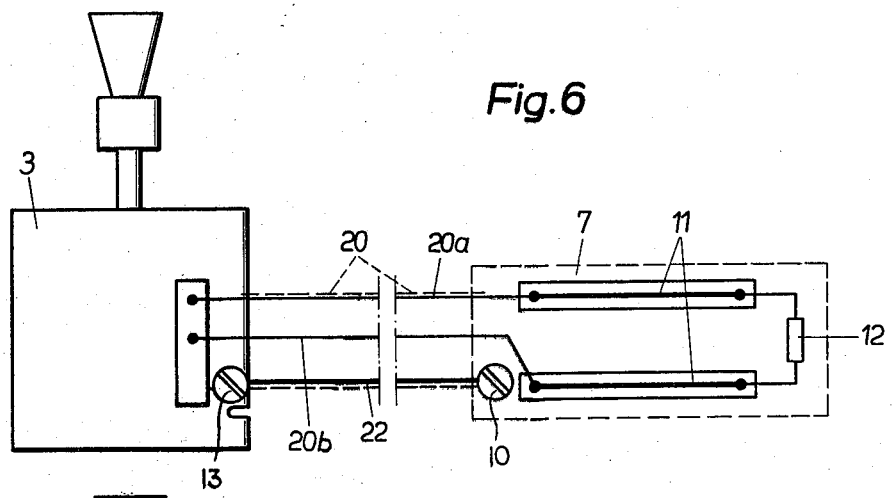

In the arrangement of FIG. 5 the use of a separate flexible and inextensible element 6 is eliminated and instead this element or chain 6 and the cable 8 are replaced by a single cable 20 secured at a clip 21 to the door 1 below the housing 3. This cable 20 as shown in FIG. 6 may have two conductors 20*a* 20*b* functionally indentical to the conductors 8*a* and 8*b*, and a third conductor 22 which is considerably larger and stronger and which fulfills the function of the chain 6 of FIG. 1.

Figure 7:
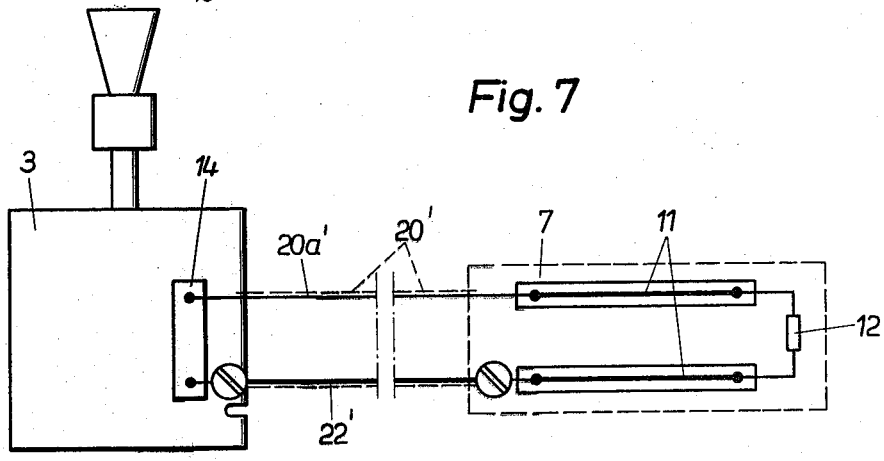

In the arrangement of FIG. 7 a cable 20' has a light-gauge conductor 20*a'* and a heavy-gauge conductor 22', the latter serving the function of the chain 6 of FIG. 1 and also serving as one leg of the conductor path to and from the end piece 7.

Figure 8:
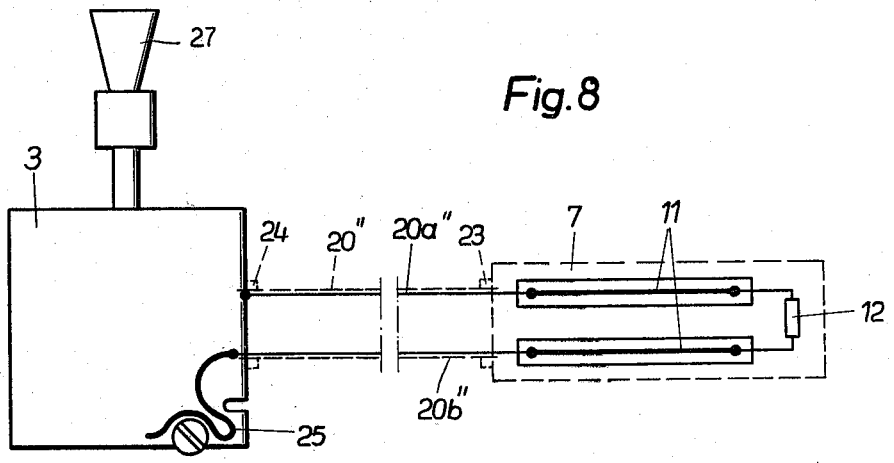
FIGS. 6, 7 and 8 are schematic diagrams illustrating alternative circuit arrangements for the apparatus of FIG. 5.

The arrangement of FIG. 8 uses a cable 20'' having a conductor 20*a''* and 20*b''*. This cable 20'' is relatively heavy and is received at a cable clamp 23 on the end piece 7 and at a similar such cable clamp 24 on the housing 3. The conductor 20*b''* is connected to circuitry of the arrangement at a weak end region 25 of the printedcircuit board for the resistance detector 26. Thus during normal use the clamps 23 and 24 will be sufficient to withstand the relatively small tensile stresses applied to the cable 20''. If too much force is exerted the clip 24 will normally release so that the conductor 20*b''* will exert a considerable pull on the fragile region 45 and will break loose the head of the mounting screw, thereby open-circuiting the arrangement and setting off the alarm 27. If this clip 24 does not release before the clip 23 the device will function either by shorting out or ripping off the strip 11 as described above with reference FIGS. 1–4.

It is of course within the scope of this invention to provide strips 11 and screws 19 on the housing 3 as well as on the end piece 7. Furthermore the alarm unit itself could be placed on the doorjamb rather than on the door, so that the resistor 12 would be on the door and the alarm 27 and operating circuit 26 on the doorjamb.

I claim:

1. A door latch and alarm apparatus comprising:

a door-mounted support;

a doorjamb-mounted support;

a relatively inextensible and flexible element anchored to said door support and having a free end provided with an end piece receivable in said doorjamb support;

latch means including key-operable mechanism on said doorjamb support for releasably securing said end piece thereto, whereby the door can open a limited distance from the doorjamb before said element becomes taut and impedes further opening;

circuit means including a pair of conductors extending between said door support and said end piece and a relatively fragile connector in said end piece forming a closed conductive path with said conductors, said connector being so much weaker than said element that when same is stressed beyond a certain limit said connector interrupts said path before said element breaks; and alarm means on said door-support connectable to said conductors for emitting an alarm when said path is interrupted.

2. The apparatus defined in claim 1 wherein said circuit means includes a resistor connected between said conductors at said end piece, said alarm means including means for detecting the resistance between said conductors and for emitting said alarm when said resistance increases or decreases substantially.

3. The aparatus defined in claim 1 wherein said circuit means includes a cable separate from said element and having said pair of conductors.

4. The apparatus defined in claim 3 wherein said element is a chain.

5. The apparatus defined in claim 3 wherein said element is shorter between said door support and said end piece than said cable.

6. The apparatus defined in claim 1, a cable extending between said door support and said end piece and having a plurality of wires constituting said element and said conductors.

7. The apparatus defined in claim 6 wherein said cable has two such wires, one constituting said element and one of said conductors and the other constituting the other conductor.

8. The apparatus defined in claim 6 wherein said cable has three such wires, one constituting said element and the other two constituting said conductors.

9. The apparatus defined in claim 1 wherein said conductors are relatively strong between said end piece and said door support and relatively fragile in said end piece.

10. The apparatus defined in claim 9 wherein each of said conductors is formed in said end piece as a fragile conductive strip constituting said connector.

11. The apparatus defined in claim 10 wherein said doorjamb support includes at least one screw securing said doorjamb support to said doorjamb and having a shank extending between and past said strips and a head overlying and overlapping said strips, whereby said strips can be pulled into short-circuiting electrical contact with said head.

12. The apparatus defined in claim 10 wherein said strips each have one end connected to the respective conductor and another end connected to the other strip.

13. The apparatus defined in claim 1 wherein one of said supports is provided with a relatively fragile anchor for said conductors and the other of said supports is provided with a more substantial anchor for said conductors.

* * * * *